US005094010A

United States Patent [19]

Jacobi et al.

[11] Patent Number: 5,094,010

[45] Date of Patent: Mar. 10, 1992

[54] VENTED ULTRAVIOLET DRYING SYSTEM FOR DRYING FIBERGLASS RESINS IN BOAT HULLS AND DECKS

[75] Inventors: Cecil Jacobi; James Woodsmall; Charles Maupin, II, all of Marshall, Mo.

[73] Assignee: AMJO Infra-Red and Ultra-Violet Drying Systems, Inc., Marshall, Mo.

[21] Appl. No.: 548,566

[22] Filed: Jul. 5, 1990

[51] Int. Cl.[5] ..... F26B 3/34

[52] U.S. Cl. ..... 34/1 R; 34/4; 362/218; 362/294; 250/504 R

[58] Field of Search ..... 34/1, 4, 17, 18, 155, 34/156, 151, 88; 250/504 R; 350/1.7, 642; 362/294, 218, 293, 232

[56] References Cited

U.S. PATENT DOCUMENTS

| | | | |
|---|---|---|---|
| 3,375,366 | 3/1968 | Scheppe | 362/294 |
| 3,942,259 | 3/1976 | Raiff et al. | 34/4 |
| 4,000,407 | 12/1976 | Keller et al. | 362/218 |
| 4,504,888 | 3/1985 | Rosenthal | 362/294 |
| 4,798,960 | 1/1989 | Keller et al. | 34/4 |

FOREIGN PATENT DOCUMENTS

| | | | |
|---|---|---|---|
| 816083 | 7/1949 | Fed. Rep. of Germany | 362/218 |

*Primary Examiner*—James C. Yeung
*Attorney, Agent, or Firm*—Litman, McMahon & Brown

[57] ABSTRACT

A radiant drying system includes a radiant energy source such as a lamphead with a mercury vapor lamp which produces radiation in the infrared and ultraviolet spectral ranges. Water-filled tubes extend through the lamphead below the lamp for filtering some of the infrared radiation. A housing or filter assembly is mounted on the bottom of the lamphead and includes downwardly-diverging walls and a bottom enclosed by a light-transmitting lens, which filters the ultraviolet radiation to reduce the output thereof in the "B" (beta) range. A fluid system circulates water through the lamphead and air through the housing assembly.

6 Claims, 1 Drawing Sheet

VENTED ULTRAVIOLET DRYING SYSTEM FOR DRYING FIBERGLASS RESINS IN BOAT HULLS AND DECKS

BACKGROUND OF THE INVENTION

1. Field of the Invention

The present invention relates generally to drying systems and in particular to a radiant energy drying system for drying and curing fiber reinforced plastic products.

2. Description of the Related Art

A variety of manufacturing and processing procedures include steps wherein liquids are dried or cured. For example, coatings of various types, such as paint, sealants, printing inks, etc. are applied in liquid form and then dried or cured to relatively hard or durable finished conditions.

Various types of products are fabricated from molten materials which can be molded, cast, extruded and otherwise shaped in a variety of molds, dies, etc. to shape the finished products into appropriate configurations. The lengths of time required for such a product to harden or cure depend on several factors, including the nature of the liquid material, the presence of accelerators or retarders and ambiant conditions such as temperature and humidity.

Radiant energy can be applied to molded and liquid-formed products by, for example, exposure to sunlight and other radiant energy sources whereby drying and curing are hastened. Various types of dryers and lamps have been used for such purposes, such as the lamp assembly shown in the Keller et al. U.S. Pat. No. 4,000,407.

Boat hulls and decks are often fabricated with fiber reinforced plastic which is placed or laid up in molds. The freshly laid-up or "green" boat hulls and decks are sometimes exposed to direct sunlight to facilitate drying and curing the fiberglass resins. However, such sunlight curing procedures can be relatively time consuming, with drying times in the approximate range of four to eight hours. Also, relatively large products such as boats can occupy substantial amounts of exterior drying area, with attendant storage and handling problems. Still further, in many areas the availability of solar insolation tends to vary considerably with the seasons, cloud cover, azimuth angular orientations, etc.

Sunlight curing procedures also have a potential disadvantage of lacking control over the spectral ranges of the radiation, whereby the products being cured can be exposed to undesirable radiant energy in certain spectral ranges. For example, infrared radiation with wavelengths in the range of about seven hundred and fifty to one million nanometers and ultraviolet radiation in the "B" or "Beta" range of about one hundred and ninety to four hundred nanometers can be undesirable for certain drying and during processes. Therefore, for certain applications it would be desirable to provide a radiant energy drying system adapted for relatively large products and with capabilities of providing consistent output in desired spectral ranges with radiant energy output in undesirable spectral ranges filtered out.

The present invention addresses these problems with previous drying and curing procedures.

SUMMARY OF THE INVENTION

In the practice of the present invention, a radiant drying system is provided which includes a radiant energy source comprising a lamphead which can include a mercury vapor tube lamp. A pair of liquid-filled tubes extend through the lamphead for filtering the radiant energy emitted thereby. The lamphead includes a downwardly-open trough lined with a reflector. A lens assembly includes a housing or shroud with a top opening mounting the lamp housing. Front and back end walls and opposite side walls taper downwardly and outwardly from the top whereby the housing has a downwardly-expanding interior. The walls terminate at a housing bottom which is covered by a transparent lens panel which can comprise a clear sheet of glass, plastic or quartz for transmitting radiation in desired spectral wave length ranges. The lens panel also acts as a filter to block transmission of radiation in the infrared range. A fluid system includes a water supply subsystem for circulating water through the lamphead and an air supply subsystem for circulating air through the housing.

OBJECTS AND ADVANTAGES OF THE PREFERRED EMBODIMENTS

The principle objects and advantages of the present invention include: providing a radiant energy system for drying and curing; providing such a system which includes a lens assembly with a housing or shroud mounted on a lamphead; providing such a system which includes a fluid-based cooling system; providing such a system which includes a liquid cooling subsystem for the lamphead; providing such a system which includes an air cooling subsystem for the lens assembly; providing such a system which is adapted for use with mercury vapor lamps; providing such a system wherein the lamps emit ultraviolet radiation; providing such a system which filters and blocks a portion of the ultraviolet radiation emitted by the lamp; providing such a system which is well adapted for drying and curing a variety of materials in a variety of processes; providing such a system which is particularly well adapted for curing fiber reinforced plastic; providing such a system which is particularly well adapted for curing boat hulls and decks constructed of fiber reinforced plastic; providing such a system which removes or filters out substantial portions of the radiant energy emitted by the lamphead; providing such a system which substantially removes ultraviolet energy in the "B" or "beta" spectral range; providing such a system which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
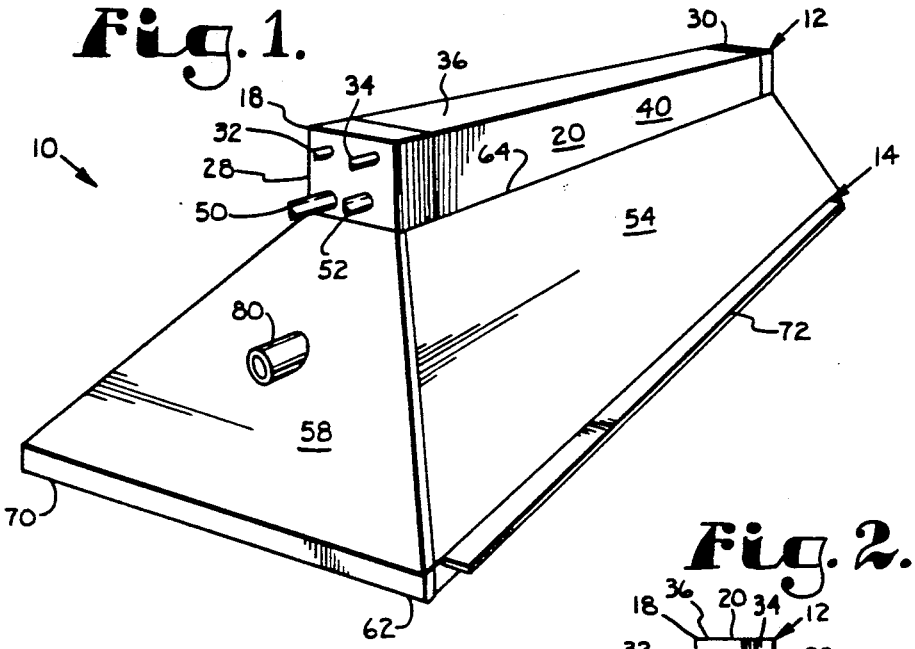
FIG. 1 is a perspective view of a radiant drying system embodying the present invention.
Figure 2:
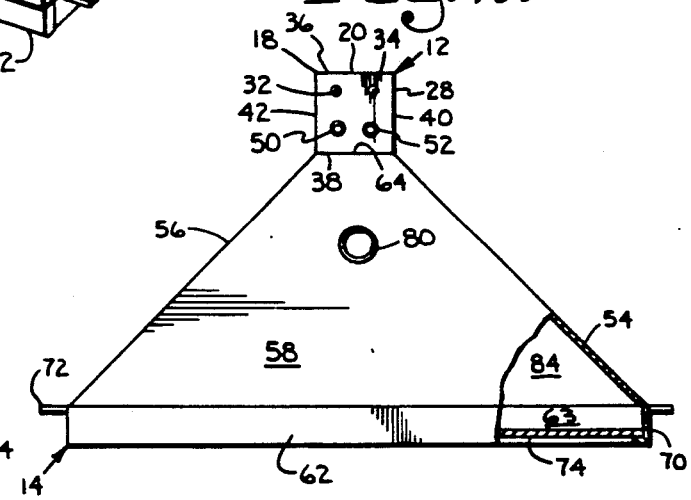
FIG. 2 is an end elevational view of the drying system with portions broken away to reveal the internal construction of a filter assembly thereof.
Figure 4:
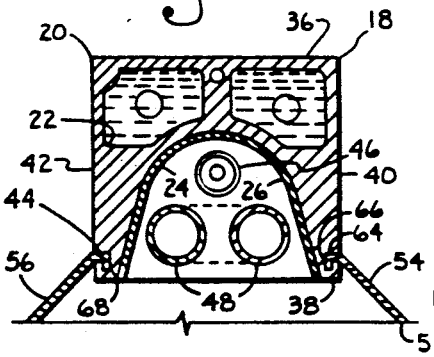
FIG. 4 is an enlarged, vertical, cross-sectional view of the system, particularly showing the internal construction of a lamphead thereof.
Figure 3:
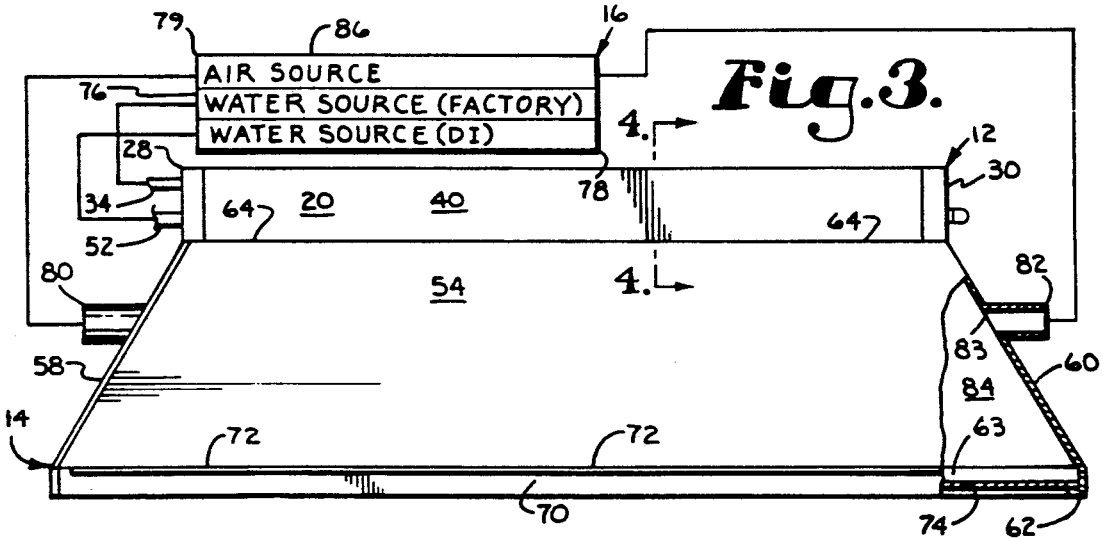
FIG. 3 is a side elevational view of the system with portions broken away to reveal the internal construction of the housing or filter assembly thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience and reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure being referred to. Said terminology will include the words specifically mentioned, derivatives thereof and words of similar import.

Referring to the drawings in more detail, the reference numeral 10 generally designates a radiant drying system embodying the present invention. Without limitation on the generality of useful applications of the drying system 10, it is described in connection with the ultraviolet drying of fiber reinforced plastic (FRP) products, such as boat hulls and decks. The drying system 10 generally includes: a radiant energy assembly 12; a housing or filter assembly 14; and a fluid system 16.

II. Radiant Energy System 12

Without limitation on the generality of useful energy systems that can be employed with the drying system 10 of the present invention, the energy assembly 12 can comprise, for example, a lamphead 18 as disclosed in the Keller et al. U.S. Pat. No. 4,000,407, which is incorporated herein by reference.

The lamphead 18 includes a case 20 with a pair of longitudinally-extending liquid passages 22 and a downwardly-open channel or trough 24 lined with a reflector 26. A first end cap 28 is mounted on one end of the case 20 and includes liquid inlet and outlet connectors 32, 34 fluidically communicating with the liquid passages 22. A second end cap 30 is mounted on the other end of the case 20.

The case 20 includes a top 36, a bottom 38 open to the trough 24 and first and second sides 40, 42. Mounting slots 44 extend longitudinally along the sides 40, 42 in closely-spaced proximity above the bottom 38.

A lamp 46 can comprise, for example, a pressurized, mercury vapor lamp. Such lamps can emit radiation in the ultraviolet (i.e. four to 400 nanometers wave length) and the infrared (i.e. 750 to 1,000,000 nanometers wave length) spectral ranges. However, for resin curing purposes it may be desirable to filter out much of this radiation, particularly the infrared range and the upper ultraviolet range (i.e. "beta" ultraviolet radiation in the range of about 190 to 400 nanometers).

To filter the infrared radiation, a pair of quartz tubes 48 extend longitudinally through the channel or trough 24. Tube inlet and outlet connectors 50, 52 are provided in the first end cap 28 and can be connected to a source of deionized ("DI") water which can be pumped through the tubes 48. A tube return connector 53 fluidically interconnects the tubes 48 at the second end cap 30. The water-filled tubes 48 function to filter the infrared radiation output of the lamp 46, and also function as a lens for the other (e.g. ultraviolet) portions of the output of the lamp 46. The lamp 46 can be connected to a suitable power source (e.g. electrical service), which is not shown.

III. Filter Assembly 14

The filter assembly 14 includes a housing 51 with: outwardly-and-downwardly sloping first and second side walls 54, 56 and first and second end walls 58, 60 whereby the housing 51 converges from a bottom or outlet face 62 to a top or inlet face 64. The top 64 includes an inlet opening 66 for the lamp case bottom 38, the housing top opening 66 being bounded at upper edges of the side walls 54, 56 by inwardly-extending flanges 68 which can be received in the case mounting slots 44. The housing 51 can include a perimeter 70 and a pair of outwardly-extending side flanges 72 at its bottom 62 for mounting purposes. A lens panel 74 covers an outlet opeing 63 in the bottom 62 and can comprise a material selected for its radiation filter characteristics. Suitable materials for the lens 74 include plate glass (e.g. one-eighth to one-quarter inch thick), quartz and plastic.

IV. Fluid System 16

The fluid system 16 includes a first water source or supply subsystem 76 for ordinary service water (i.e. "factory" water). The first water source or supply subsystem 76 is connected to the inlet and outlet connectors 32, 34 in the end cap 28 for circulating service water 77 through the liquid passages 22.

The tube inlet and outlet connectors 50, 52 communicate fluidically with the tubes 48 through the first end caps 28 and can be connected to a second water source or supply subsystem 78, which preferrably supplies and circulates deionized ("DI") water 79 for effective functioning of the DI water-filled tubes 48 as filters and lenses.

Tubular air inlet and outlet connectors 80, 82 are provided in openings 83 in the housing end walls 58, 60 respectively and communicate with an interior 84 of the housing assembly 14. The air connectors 80, 82 can be connected to a suitable air source or supply subsystem 86, for example, a blower or a fan. For typical applications of the drying system 10, a fan with an output of about 800 CFM can be utilized. Alternatively, a compressed air or air circulation system in the facility where the drying system 10 is installed can be utilized. Air can also be circulated through the lamphead 18.

V. Operation

In operation, the radiant drying system 10 can be utilized for a variety of curing and drying operations, particularly where spectral radiation filtering and selectivity is desired. For example, and without limitation on the generality of useful applications of the drying system 10, it can be utilized to cure fiber reinforced plastic ("FRP"). More specifically, a high performance marine resin is available under the trademark AME 4000 from the Ashland Chemical Company, Division of Ashland Oil, Inc. of Dublin, Ohio. AME 4000 resin can be used to form FRP boat hulls and decks, among other applications, both marine and non-marine. Drying time of boat hulls and decks with the drying system 10 can be reduced to approximately 30 minutes for a boat hull or a boat deck, compared to drying times in the approximate ranges four to eight hours when such components are cured in direct sunlight.

Table 1 shows the approximate effectiveness, as tested, of one-eighth inch and one-quarter inch glass filter lenses 74 in reducing radiation in the ultraviolet "B" (beta) range, compared to a similar drying system with no lens.

TABLE 1

| Lamp Power Setting (Watts per inch of lamp length) | Approximate Percentage Reduction of UV Beta Radiation | |
|---|---|---|
| | ⅛" Thick Glass Filter Lens | ¼" Thick Glass Filter Lens |
| 300 w/in | 96.2% | 97.3% |
| 200 w/in | 96.8% | 97.8% |
| 125 w/in | 98.3% | 98.6% |

It is to be understood that while certain forms of the present invention have been illustrated and described herein, it is not to be limited to the specific forms or arrangement of parts described and shown.

What is claimed and desired to be secured by Letters Patent is as follows:

1. A filter assembly for a radiant energy lamp head assembly which comprises:

(a) an inlet face, an outlet face and wall means interconnecting said faces in spaced-apart relation;

(b) said inlet and outlet faces having inlet and outlet openings respectively;

(c) radiant energy filter means mounted on said outlet face in covering relation with respect to said outlet opening for selectively filtering radiant energy;

(d) means for mounting the lamp head assembly on the inlet face for transmitting radiant energy into the filter assembly;

(e) air inlet and outlet means in said wall means for admitting and discharging air to and from said filter assembly; (f) means for circulating air through said filter assembly and associated with said air inlet and outlet means; and (g) said wall means diverging from said inlet face to said outlet face.

2. The invention of claim 1 wherein:

(a) said filter means comprises a flat panel of a transparent material.

3. The invention of claim 2 wherein said filter means comprises a pane of glass.

4. The invention of claim 1 wherein said air inlet and outlet means comprise inlet and outlet openings in said wall means and inlet and outlet tubular connectors communicating with said inlet and outlet openings respectively.

5. The invention of claim 1 wherein:

(a) said wall means includes first and second end walls; and (b) said air inlet and outlet means being mounted in said first and second end walls respectively.

6. A radiant energy drying system, which includes:

(a) a lamphead including:

(1) first and second opposite ends;

(2) a top;

(3) a bottom;

(4) first and second opposite sides;

(5) a pair of liquid passages extending longitudinally between said opposite ends;

(6) a pair of end caps mounted on the ends;

(7) a trough extending longitudinally between the ends and open downwardly at the bottom;

(8) a reflector lining said trough;

(9) a mercury vapor tube lamp extending longitudinally within said trough between said ends;

(10) a pair of lens tubes extending longitudinally in parallel spaced relation within said trough between said ends and below said lamp tube; and

(11) a pair of slots each extending along a respective lamphead side in proximity to said lamphead bottom; and (b) a filter assembly, which includes:

(1) a housing with:

(i) a top with an opening receiving said casing bottom and a pair of flanges received in said casing slots;

(ii) a bottom with an opening;

(iii) opposite first and second end walls;

(iv) opposite first and second side walls;

(v) an interior enclosed by said walls between said top and bottom; and (vi) said walls diverging downwardly whereby said interior expands downwardly; and (2) a plate glass filter panel mounted on said walls in covering relation with respect to said bottom opening; and (c) a fluid system, which includes:

(1) a first water supply subsystem including a first liquid source and casing inlet and outlet connectors on said first end block communicating with said casing water passages and a return passage in said second end block fluidically connecting said passages;

(2) a second liquid source subsystem including a second liquid source, lens tube inlet and outlet connectors in said first end block communicating with said lens tubes and a connector tube mounted on said second end block and interconnecting said lens tubes; and (3) an air supply subsystem including an air inlet tube mounted on said housing first end wall and communicating with said housing interior, an air outlet tube mounted on said housing second end wall and communicating with said housing interior, and a blower pneumatically connected to said air inlet tube.

* * * * *